US006397427B1

(12) United States Patent
Bryngelsson

(10) Patent No.: US 6,397,427 B1
(45) Date of Patent: Jun. 4, 2002

(54) MOP

(75) Inventor: Peter Bryngelsson, Hudiksvall (SE)

(73) Assignee: Pro-Gruppen AB, Stockholm (SE)

( * ) Notice: Subject to any disclaimer, the term of this patent is extended or adjusted under 35 U.S.C. 154(b) by 0 days.

(21) Appl. No.: 09/514,246

(22) Filed: Feb. 28, 2000

Related U.S. Application Data

(63) Continuation of application No. PCT/SE98/01521, filed on Aug. 26, 1998.

(30) Foreign Application Priority Data

Aug. 28, 1997 (SE) ..... 9703094

(51) Int. Cl.[7] ..... A47L 13/20

(52) U.S. Cl. ..... 15/228; 15/143.1; 15/144.2; 15/229.6; 15/244.2; D32/50; D32/51

(58) Field of Search ..... 15/143.1–144.4, 15/228, 296.6–229.9, 244.2; D32/50, 51

(56) References Cited

U.S. PATENT DOCUMENTS 1,315,194 A * 9/1919 Yamamoto ..... 15/143.1 X
2,244,585 A * 6/1941 Tweit ..... 15/143.1 X
4,704,758 A * 11/1987 Hoffman ..... 15/144.4
4,852,210 A * 8/1989 Krajicek ..... 15/228
5,133,101 A * 7/1992 Hauser et al. ..... 15/143.1
D359,605 S * 6/1995 Janikowski ..... D32/51
D388,934 S * 1/1998 Ames, Jr. et al. ..... D32/51 X

FOREIGN PATENT DOCUMENTS

FR 619051 * 3/1927 ..... 15/144.1

* cited by examiner

*Primary Examiner*—Mark Spisich
(74) *Attorney, Agent, or Firm*—Browdy and Neimark

(57) ABSTRACT

A mop (1) for dry or wet mopping comprises an elongated mop-holder (2) and a shaft (9), which is connected to the mop-holder (2) by a universal joint (7). The universal joint (7) has a first pivot axis (a) extending in the longitudinal direction (A) of the mop-holder (2) and in parallel with the pane of the mop-holder, and a second pivot axis (b) perpendicular to the first pivot axis. The shaft (9)has a handle portion (10) and a coupling portion (11), which connects the handle portion (10) to the universal joint (7) and which is so designed that the longitudinal axis (C) of the handle portion (10) is displaced in relation to the universal joint (7) so as to intersect the plane (AB) beside the first pivot axis (a).

5 Claims, 2 Drawing Sheets

MOP

This application is a continuation of International Appln. No. PCT/SE98/01521, filed Aug. 26, 1998, the entire contents of which being hereby incorporated herein by reference.

FIELD OF THE INVENTION

The present invention relates to a mop for dry or wet mopping comprising an elongated mop-holder and a shaft, which is connected to the mop-holder by means of a universal joint, which has a first pivot axis extending in the longitudinal direction of the mop-holder and in parallel with the plane of the mop-holder, and a second pivot axis perpendicular to said first pivot axis.

BACKGROUND OF THE INVENTION

Mops of the type described above are in particular used for so-called dry mopping or wet mopping with a mop-holder, whose underside is coated with a dry or wet dust-absorbing paper or textile cloth, which the user of the mop sweeps over a floor surface to be cleaned in a swinging zigzag movement while walking backwards. In this connection, the floor surface which the cloth sweeps over is suitably increased by an inclining of the mop-holder towards the sweeping direction, more specifically so that the end of the mop-holder, which is for the time being at the front in the sweeping direction of the mop-holder, is at a greater distance from the user than the end which is then at the back in the sweeping direction. The inclination is achieved by the user somewhat turning the shaft of the mop at the end of each swinging movement by a slight motion of the wrist.

In spite of the fact that today's mops are made of very light materials, such as aluminium or plastic, and that dry mopping is considerably less strenuous than wet mopping, it has been found that also the very limited motion of the mop user's wrist during the sweeping movement can cause strain injuries in course of time.

OBJECT OF THE INVENTION

In consideration of that stated above, the object of the present invention is to provide a mop, in which the above-described motion of the wrist is restricted to a minimum, and instead the desired inclination is achieved by means of a motion which is less strenuous for the human body.

SUMMARY OF THE INVENTION

With a mop of the type mentioned by way of introduction this object is achieved, by the shaft having a handle portion and a coupling portion, which connects the handle portion to the universal joint and which is so designed that the longitudinal axis of the handle portion is displaced in relation to the universal joint so as to intersect said plane beside the first pivot axis.

Thanks to this solution, a user of the inventive mop, when the mop is in such a position that the point of intersection is located between the universal joint and the user, only has to perform a simple pulling movement for the desired inclination to arise. The reason for this is that the mop-holder always strives to turn one of its long sides towards said point of intersection, which causes a varying degree of inclination depending on its distance from the universal joint.

Preferably, the longitudinal axis of the handle portion intersects said plane at a distance from the first pivot axis corresponding to half to twice, preferably once, the width of the mop-holder.

It is understood that said ratio entirely depends on the width of the used mop-holder, which can be e.g. between 80 and 100 mm for a normal mop-holder with a length of between 400 and 600 mm.

According to the invention, the mop is also preferably designed such that the coupling portion is substantially S-shaped, its two end portions are parallel to the longitudinal axis of the handle portion and its intermediate portion located between the end portions provides displacement of the handle portion in relation to the universal joint.

An intermediate portion designed in this manner is very easy to manufacture and most comfortable to use because of its smooth shape.

Suitably, the coupling portion is also replaceable to vary the degree of displacement of the handle portion in relation to the universal joint.

Such a replaceable coupling portion, in addition to the possibility of varying the inclination of the mop-holder by different degrees of displacement during the sweeping movement described above, also permits the application of the invention in connection with an ordinary mop by placing such a coupling portion between its shaft or handle portion and its mop-holder with the universal joint.

Finally, in order to further reduce the strain on the user's wrists when mopping, at least part of the handle portion can be enclosed by a rotatable sleeve. Thanks to this sleeve, the wrist of the hand gripping the sleeve does not have to be twisted at all in order to follow the natural turning movement of the handle portion provided by the invention.

BRIEF DESCRIPTION OF THE DRAWINGS

In the following, preferred embodiments of the invention will be described in detail with reference to the drawings, in which.

DESCRIPTION OF TWO EMBODIMENTS

Figure 1:
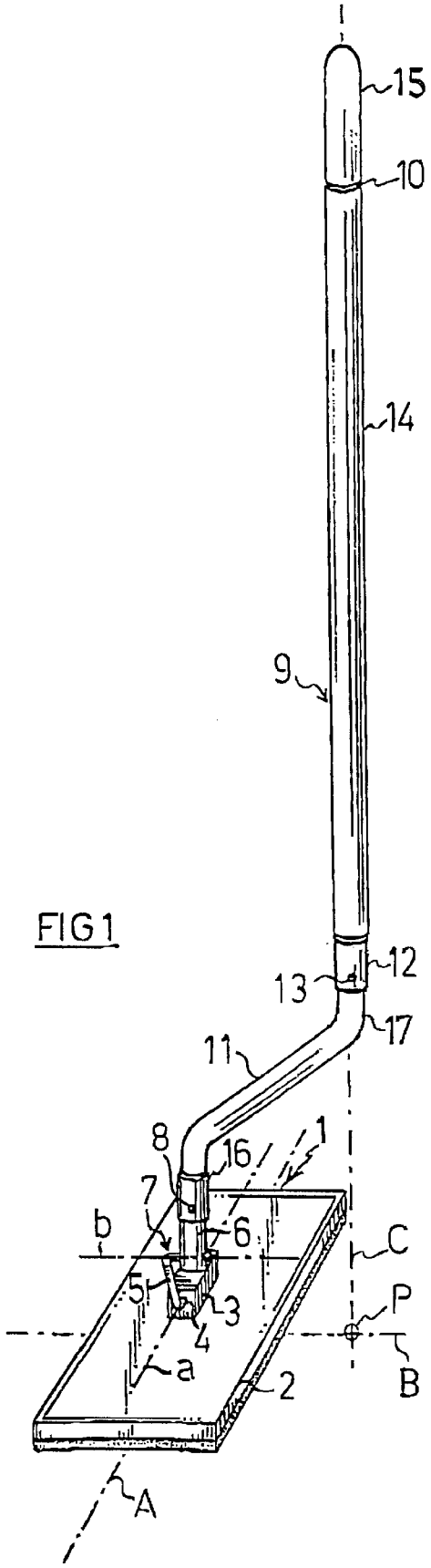
FIG. 1 is a perspective view of an inventive mop.

The mop 1 in FIG. 1 comprises a mop-holder 2, which here has the form of a rectangular plate of rigid plastic, under which a cellular plastic layer is arranged. The mop-holder 2 defines a plane illustrated in the drawing by a first axis A, which extends in the longitudinal direction of the mop-holder 2 and is parallel to the underside of the mop-holder 2, and a second axis B, which is perpendicular to the first axis A, extends in the transverse direction of the mop-holder 2 and is parallel to the underside of the mop-holder 2.

On its upper side, the mop-holder 2 has a centrally arranged holder 3, which has an aperture 4 extending in the longitudinal direction of the mop-holder 2. In the aperture 4, a bent wire element 5 is rotatably mounted. The wire element defines a first axis a, which extends in the longitudinal direction of the mop-holder 2 and is parallel to the plane of the mop-holder 2 (in the following designated AB), and a second axis b, which is perpendicular to the first axis and which, in the drawing, is shown in a position where it is also parallel to the plane AB of the mop-holder 2. It is understood, however, that this parallelism is suspended when the wire element 5 is rotated about its axis a.

On the part of the wire element 5 defining the axis b, a shaft mounting 6 is rotatably mounted. The shaft mounting forms together with the wire element 5 and the holder 3 a universal joint, in the following designated 7. The one skilled in the art will understand that the universal joint 7 can also have a design other than that shown in FIG. 1 and that, for instance, the two pivot axes a and b then can be located in the same plane.

The shaft mounting 6 is tubular and has a pin means. 8, which can be pressed into the shaft mounting 6 against the action of a spring (not shown) to permit the attachment of a shaft 9.

The shaft 9 shown in FIG. 1 has a straight handle portion 10 and a bent coupling portion 11. The handle portion 10 can be an ordinary tool handle, which in its lower part has a sleeve portion 12 with at least one hole 13 for a pin of the same type as the shaft mounting 6. Moreover, the handle portion 10 shown in FIG. 1 also has a sleeve 14, which is rotatably mounted on the handle portion and is arranged to facilitate the use of the mop by limiting the motions of the wrist which are necessary when using the mop. Finally, the handle portion 10 also has a fixed grip 15, which in FIG. 1 is arranged at the top and, for ergonomic reasons, has at least a rounded top.

The coupling portion 11 of the shaft 9 is, as shown, connected to both the handle portion 10 and the shaft mounting 6. For this purpose, it is provided with a sleeve portion 16 adjacent to the shaft: mounting 6, corresponding to the sleeve portion 12, and a cylindrical portion 17 which is arranged adjacent to the connection to the handle portion 10, has a shape substantially corresponding to that of the shaft mounting 6 and also comprises a spring-biased pin means corresponding to the pin means 8.

Figure 2:
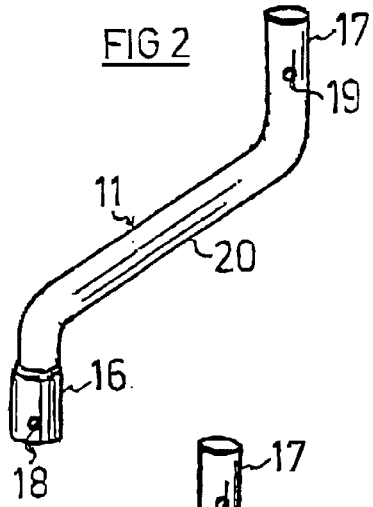
FIGS. 2 and 3 show two different coupling portions matching the mop and FIG. 4 is a perspective view of an alternative embodiment of an inventive mop.
Figure 3:
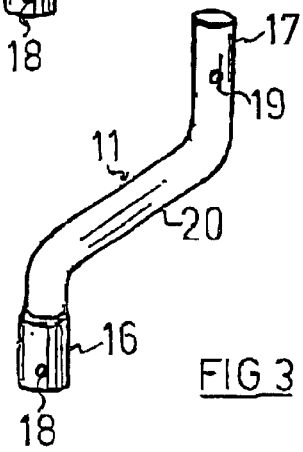

Examples of coupling portions 11 are shown in FIGS. 2 and 3, where the sleeve portions 16 are clearly shown with their openings 18 intended for the pin means 8 of the shaft mounting 6 and their own pin means 19 in the cylindrical portion 17. Moreover, FIGS. 2 and 3 show that an intermediate portion 20 located between the sleeve portion 16 and the cylindrical portion 17, which are parallel, can have different length, and even if this is not shown it can, of course, be positioned at a different angle to the sleeve portion 16 and the cylindrical portion 17 from that shown.

As is apparent from FIG. 1, the coupling portion 11 results in displacement of the handle portion 10, which in a normal mop is aligned with the shaft mounting 6, away from the shaft mounting, and thus away from the universal joint 7, in the transverse direction of the mop-holder 2. The purpose of this displacement is to make the longitudinal axis C of the handle portion 10 intersect the plane AB of the mop-holder 2 beside the pivot axis a of the universal joint 7, which in the position shown in FIG. 1 occurs at a point P where the axis B and the longitudinal axis C intersect.

The one skilled in the art understands that the point P is movable depending on the position of the shaft 9 and that, for instance, it moves closer to the mop-holder 2 when the shaft 9 shown in FIG. 1 is rotated to the right about the pivot axis a. The point P is, however, always located beside the pivot axis a in the operating positions and, when the mop-holder 2 is pulled over a floor surface, it always defines the point with which the mop-holder is aligned. This implies that, in the sweeping movement described by way of introduction, the inventive mop is automatically inclined without the user having to do anything but a simple pulling movement to the right and to the left, respectively, the point P being located somewhere between himself and the universal joint 7.

It is understood that the above-described mop 1 can be varied in different ways within the scope of the invention. Thus the shaft 9 can be in one piece instead of in the two portions 10 and 11 shown, and in particular the coupling portion, whether integral with the shaft 9 or not, can have a completely different design.

To illustrate this, an alternative embodiment of the mop according to the invention is described below with reference to FIG. 4.

Figure 4:
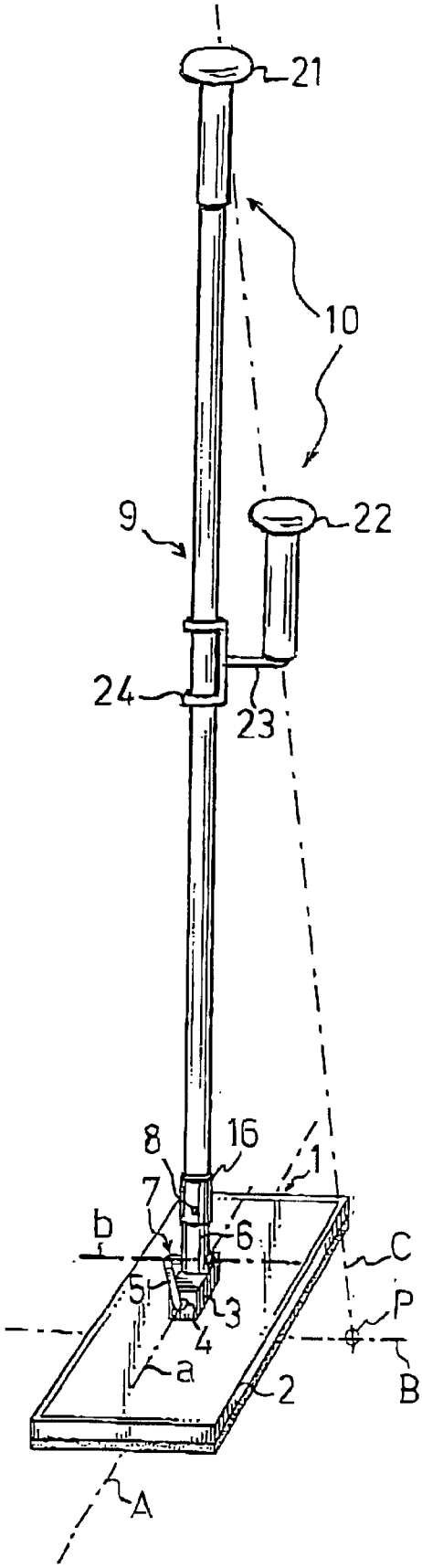

The mop 1 shown in FIG. 4 has the same type of mop-holder 2 as the embodiment previously described. Therefore, the same reference numerals have been used for this mop-holder 2 and reference is made to tile description above.

The difference between the mops in FIGS. 1 and 4 consist in the design of the shaft 9, more specifically in the design of the handle portion 10 and the coupling portion 11. The latter consists of a straight tube, which has a sleeve portion 16 down in the lower part for connecting the shaft mounting 6 of the mop-holder 2. The former consists of two separate, rotatable handles 21, 22, or which the upper is mounted on the upper end of the coupling portion 11 and of which the lower is mounted on a projecting arm 23 on a bracket 24, which is attached to the coupling portion 11. The two handles 21, 22 together define a longitudinal axis C, which intersects the plane AB of the mop-holder 2 in the manner described above in a point P and thus provides the aimed-at displacement away from the pivot axis a of the universal joint 7.

It is understood that the length of the arm 23 and the position of the bracket 24 on the coupling portion have a decisive influence on the effected displacement and that therefore, for instance, the bracket 24 can be arranged in a displaceable manner on the coupling portion 11.

What is claimed is:

1. A mop for dry or wet mopping comprising an elongated and substantially flat mop-holder (2) and a shaft (9) which is connected to the mop-holder (2) by a universal joint (7), said universal joint having a first pivot axis (a) extending in the longitudinal direction (A) of the mop-holder (2) and in parallel with the plane (AB) of the mop-holder (2), and a second pivot axis (b) perpendicular to said first pivot axis, characterized in that the shaft (9) has a handle portion (10) having a longitudinal axis, and a coupling portion (11) which connects the handle portion (10) to the universal joint(7) and which is so designed that the longitudinal axis(C) of the handle portion (10) is displaced in relation to the universal joint (7) so as to intersect said plane (AB) beside the first pivot axis (a); and in that the coupling portion (11) is substantially S-shaped, its two end portions (16, 17) are parallel to the longitudinal axis (C) of the handle portion (10), and an intermediate portion (20) located between the end portions (16, 17) provides displacement of the handle portion (10) in relation to the universal joint (7).

2. A mop according to claim 1, characterized in that the longitudinal axis (C) of the handle portion (10) intersects said plane (AB) at a distance from the first pivot axis (a) corresponding to half to twice the width of the mop-holder (2).

3. The mop of claim 2 wherein said distance corresponds to once the width of the mop-holder.

4. A mop according to claim 1, characterized in that the coupling portion (11) is replaceable to vary the degree of displacement of the handle portion (10) in relation to the universal joint (7).

5. A mop according to claim 1, characterised in that at least part of the handle portion (10) is enclosed by a rotatable sleeve (14).

* * * * *